United States Patent [19]

Broeckx et al.

[11] 4,142,865

[45] Mar. 6, 1979

[54] LOW POUR HYDROCARBON OIL COMPOSITIONS

[75] Inventors: Willy P. Broeckx, Reet, Belgium; Lothar G. Dulog, Oberjettingen, Fed. Rep. of Germany

[73] Assignee: S.A. Texaco Belgium N.V., Belgium

[21] Appl. No.: 842,447

[22] Filed: Oct. 14, 1977

[51] Int. Cl.[2] ..... C10L 1/18

[52] U.S. Cl. ..... 44/62; 44/80

[58] Field of Search ..... 44/62, 80

[56] References Cited

U.S. PATENT DOCUMENTS

| | | | |
|---|---|---|---|
| 3,157,624 | 11/1964 | de Vries et al. | 44/62 |
| 3,288,577 | 11/1966 | Patinkin et al. | 44/80 |
| 3,340,030 | 9/1967 | Gaston et al. | 44/62 |
| 3,393,057 | 7/1968 | Clough et al. | 44/62 |
| 3,418,259 | 12/1968 | Kennedy et al. | 526/11.1 |
| 3,440,187 | 4/1969 | Young et al. | 44/62 |
| 3,446,740 | 5/1969 | Young et al. | 44/62 |
| 3,817,721 | 6/1974 | Perilstein | 44/80 |

*Primary Examiner*—Winston A. Douglas
*Assistant Examiner*—Y. Harris-Smith
*Attorney, Agent, or Firm*—Carl G. Ries; Thomas H. Whaley; Walter D. Hunter

[57] ABSTRACT

Low pour point hydrocarbon oil compositions are prepared by incorporating in a hydrocarbon oil such as crude oil, gas oil, residual fuel oil, etc. about 0.01 to about 0.5 percent by weight of an oil-soluble alkylated polybenzyl polymer or copolymer with, for example styrene, the said polymer or copolymer having a molecular weight of about 500 to about 50,000 or more. The polymer or copolymer may be added, for example, as a hydrocarbon solution to the base hydrocarbon oil after which the final oil composition is formed by heating the components to 100° to 350° F. for one hour or more with mixing.

10 Claims, No Drawings

LOW POUR HYDROCARBON OIL COMPOSITIONS

BACKGROUND OF THE INVENTION

1. Field of the Invention

This invention is concerned with improving the flow properties and pour point characteristics of hydrocarbon oils. More particularly, this invention is concerned with low-pour hydrocarbon oil compositions comprising a hydrocarbon oil such as a middle distillate, a gas oil, a residual fuel oil, crude oil, etc. and an effective pour-depressant amount of an oil-soluble, alkylated polybenzyl polymer or copolymer.

2. Description of the Prior Art

As is well known, many hydrocarbon oils contain quantities of wax which render them viscous and give unacceptably high pour points. These oils behave as non-Newtonian liquids at low temperatures: exhibit variable solidifying temperature and peculiar hysteresis phenomena all of which render them difficult to use as fuel.

One approach used in converting these oils has been to subject them to fairly lengthy dewaxing procedures. This, however, is an expensive process.

Another approach which has been used to bring the viscosity of the waxy hydrocarbon oils to suitable levels has been to dilute or "cut" them with a major amount of lighter distillate oils but this also is an expensive procedure because of the considerably higher costs of the distillate oils relative to the higher boiling oils.

A number of additives have been suggested and tried with success in lubricating oils, middle distillates, gas oils, etc. in order to tie in the wax therein and improve flow at low temperatures. Such additives consist either of compounds such as alkylated polystyrene, etc. or of copolymer of ethylene-vinyl saturated aliphatic monocarboxylic acid esters of a molecular weight up to 3000 and containing from 15 to 25 percent by weight of the vinyl saturated aliphatic monocarboxylic acid ester. These known additives are not, however, effective in depressing the pour point of certain hydrocarbon oil compositions.

In recent years the restrictive specifications limiting the sulfur content of fuel oils including those containing a major amount of gas oils has made the manufacture of such fuels a much more difficult task than previously. In many localities, low-sulfur, high-pour fuels are being substituted for previously utilized high-sulfur low-pour fuels. In order to meet the stringent pour point specifications of such fuel oils pour depressants are being used. A particular effective class of pour depressants are the ethylene-vinyl acetate copolymers having molecular weights ranging from about 15,000 to about 60,000 and having an ethylene content of about 45 to about 90 percent. Although the ethylene-vinyl acetate copolymers have been shown to be effective in reducing the pour points of crudes and fuel oil blends containing distillate they have not been found to be very effective in reducing the pour points of certain other hydrocarbon oils such as vacuum gas oils, etc.

It is therefore the main object of the present invention to provide low pour hydrocarbon oil compositions based on middle distillates, gas oils, residual fuel, crude oils, etc. and containing an effective pour depressant amount of an alkylated polybenzyl polymer or copolymer.

BRIEF DESCRIPTION OF THE INVENTION

The low-pour hydrocarbon oil compositions of this invention comprise a blend of a hydrocarbon oil or oils and about 0.01 to about 0.50 weight percent of an oil-soluble, alkylated polybenzyl polymer or copolymer with styrene, propylene, 1-hexene, etc. or mixtures thereof.

DETAILED DESCRIPTION OF THE INVENTION

The oil soluble polymers employed as pour depressants in the hydrocarbon oil compositions of this invention are prepared by polymerizing a compound of the formula:

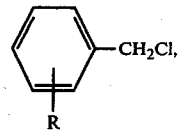

wherein R is alkyl of from 8 to about 26 carbon atoms as exemplified by octyl, isoctyl, t-nonyl, isononyl, decyl, isodecyl, heptadecyl, etc. These polymers have recurring units of the formula:

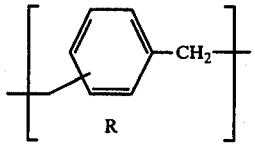

wherein R has the same meaning as previously described and exhibit molecular weights of about 500 to about 50,000 or more as determined by vapor pressure osmometry.

Preparation of the above-described polymers can be conveniently carried out according to the process set out in U.S. Pat. No. 3,418,259 which is incorporated herein by reference in its entirety. For example, polymerization of of p-dodecyl benzyl chloride proceeds as follows:

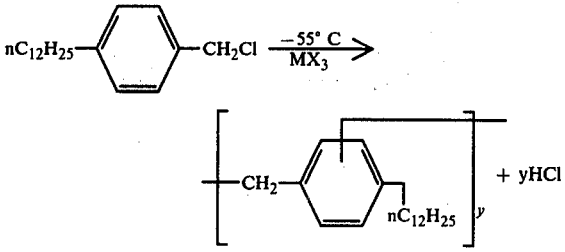

where $MX_3$ represents a Friedel-Craft catalyst such as $AlCl_3$, etc.

As previously pointed out oil-soluble random copolymers of the above-described benzyl compounds with alpha-olefins having from 3 to 20 carbon atoms such as propylene, 1-butene, 1-pentene, 1-hexene, 1-heptene, 1-octene, 1-nonene, 1-decene, 1-tetradecene, etc. or styrene are also useful pour depressants. Such copolymers comprise randomly arranged units of the following types:

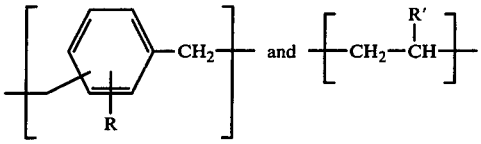

wherein R has the same meaning as previously described and R′ is selected from the group consisting of the phenyl and straight chain alkyl of from 4 to about 18 carbon atoms. Mixtures of these same random copolymers may also be employed in the hydrocarbon oil compositions of this invention. In the copolymers mentioned above generally the units derived from the benzyl compounds will constitute from about 30 to about 90 and, preferably, about 60 to about 90 percent by weight of the copolymer with the balance being derived from the other monomer or monomers employed. These copolymers which have average molecular weights of about 500 to about 50,000 or more can be prepared in the same manner as the polybenzyl polymers according to the methods set out in U.S. Pat. No. 3,418,259.

In preparing the hydrocarbon oil compositions of this invention, the useful polybenzyl polymers or copolymers may be added with mixing directly to the hydrocarbon oil as granules or as a hydrocarbon solution in toluene, kerosene, etc. Preferably, the polybenzyl polymers or copolymers or solution thereof are added to the hydrocarbon oil with mixing at a temperature of about 100° to about 350° F. and preferably at 100° to 180° F.

It will be evident to those skilled in the art that other additives commonly employed in hydrocarbon compositions may be added to the compositions of this invention. Such additives include rust inhibitors, anti-emulsifying agents, anti-static agents, anti-oxidants, etc.

In this specification all pour point determinations referred to are conducted according to the method of ASTM D-97.

As previously pointed out the described polybenzyl polymers and copolymers are useful as pour depressants in a wide variety of hydrocarbon oils such as middle distillates, gas oils, residual fuels, crude oils, etc.

Middle distillates suitable for preparing hydrocarbon oil composition of this invention generally will have boiling points of about 250° to 650° F.

The gas oils utilized in this invention generally will boil between about 450° and 1050° F. Typical of the gas oils which may be employed are Desulfurized Arabian Gas Oil, Desulfurized Lago Medio Vacuum Gas Oil, Arabian Vacuum Gas Oil, etc., whose physical properties are set out in Table 1 which follows:

TABLE 1

| | Desulfurized Arabian Vac. Gas Oil (DS Arab. VGO) | Desulfurized Lago Medio Vac. Gas Oil (DS Lago Medio VGO) | Arabian Vac. Gas Oil (Arab. VGO) |
|---|---|---|---|
| Boiling Range | 650–1020° F | 650–1050° F | 650–1020° F |
| Pour Point, ° F (ASTM D-97) | +100 | +95 | +90 |
| Pour Point, (max) ° F | +110 | +95 | +90 |
| Sulfur, Wt. percent | 0.3 | 0.16 | 2.6 |
| Wax Content, Wt. Percent | 5.0 | 6.27 | 3.0 |
| Viscosity at 210° F, C | | | |
| API Gravity, at 60° F | 24.0 | 27.5 | 23.3 |
| Gas Oil Distillation, ° F, Vol. % | | | |
| IBP 10 | | | 730–790 |
| 10–20 | | | 808 |
| 20–40 | | | 843 |
| 40–60 | | | 880 |
| 60–80 | | | 922 |
| 80–92 | | | Cracked |

Typical high pour residual fuel oils useful in preparing the fuel oil compositions of this invention include, for example, residual fuel oils having an API gavity of about 10.0 to about 30.00; a sulfur content of between about 0.10 to about 0.96 weight percent; a SUS viscosity at 122° F. of about 150 to about 2000; a pour point of between about 70 and 115° F.; a flash point of between about 300 and 450° F.; and a wax content of between about 2 and 20 percent.

The physical properties of two typical waxy, high pour residual fuel oils suitable for use in preparing the fuel oil compositions of this invention are set forth in Table 2 which follows:

TABLE 2

BASE STOCK INSPECTION TESTS

| TEST | BASE STOCK: Trinidad F-30 Fuel Oil | BASE STOCK: Fuel Oil A |
|---|---|---|
| Gravity, API | 24.1 | 29.6 |
| Flash Point (PM, ° F) | 210 | 303 |
| Viscosity, SUS at 122° F | 103.2 | 86.0 |
| Viscosity, SUS at 150° F | 70.2 | 55.0 |
| ASTM Pour Point, ° F | 80 | 80 |
| Wax Content, Weight Percent | 12.7 | 8.0 |
| Sulfur, Weight Percent | 0.18 | 0.18 |

Examples of typical crude oils which may be employed in preparing the crude oil composition of this invention include those described in Table 3 below.

TABLE 3

| IDENTIFICATION | AMNA | NAFOORA | ARABIAN |
|---|---|---|---|
| API° at 60° F | 34.8 | 34.7 | 33.5 |
| Pour Point, ° F | +80 | +80 | −10 |
| Maximum Pour Point, ° F | +75 | +85 | — |
| Kin. Vis. at 100° F, CS | 17.66 | 25.0 | 7.05 |
| Wax Content, Wt. Percent | 14.2 | 15.5 | 2.0 |
| Yield Stress at 32° F dynes/cm$^2$ | 800 | 800 | Pass |

The following examples which illustrate various embodiments of the invention are to be considered not limitative.

EXAMPLE 1

A low molecular weight polymer of p-dodecylbenzyl chloride was prepared in the following manner:

5.88 g (0.02 mole) of p-dodecylbenzyl chloride is treated with 0.133 g $AlCl_3$ (0.001 mole) at room temperature. A slow evolution of HCl occurs, which becomes vigorous on gentle heating. The brown viscous oil formed after reaction is soluble in benzene and precipitates in methanol. A 200 ml benzene solution of the product was poured into 250 ml of water, washed three times with 250 ml water, separated, dried over $MgSO_4$ and the benzene was distilled off. The final product is a red viscous oil (i.e., a low molecular weight polymer).

The effectiveness of the above-described polymer was determined in Heating Oil A which has the following characteristics:

| | | | |
|---|---|---|---|
| Spec. Grav. 15C | 0.8330 | Distillation | ° C |
| Flash Pt, PM ° C | 71 | IBP | 167 |
| Kin Vis cSt at 20C | 4.43 | 5% | 180 |
| 37C | 3.55 | 10 | 192 |
| Cloud Pt, ° C | −2 | 20 | 215 |
| Pour Pt, ° C | −4 | 30 | 235 |
| Sulfur, wt % | 0.49 | 40 | 258 |
| FIA : Aromatics v % | 36.5 | 50 | 278 |
| Saturates v % | 63.0 | 60 | 295 |
| Olefins v % | 0.5 | 70 | 312 |
| | | 80 | 329 |
| | | 90 | 343 |
| | | 95 | 350 |
| | | FBP | 372 |
| | | Rec. & Loss | 2% |

When 500 ppm of the above-described p-dodecylbenzyl polymer is added to Heating Oil A a reduction in pour point (ASTM D-97) from −4° C. to −12° C. is achieved.

EXAMPLE II

A concentrate containing 1.5 percent by weight of a polybenzyl polymer having a number average molecular weight of about 2,300 and having recurring units of the formula:

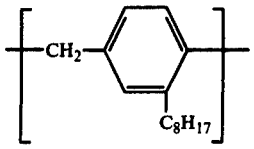

is prepared by adding sufficient of the oil-soluble polymer to toluene at 150° with mixing. The thus-prepared concentrate is then incorporated at 135° F. with mixing in a middle distillate fuel oil boiling between 360–454° F. and having a pour point of 20° F. to form a middle distillate composition containing 0.02 percent by weight of the polybenzyl polymer. After one month the pour point is again determined and found to be substantially below that exhibited initially by the pure middle distillate.

EXAMPLE III

Granules of an oil-soluble random-type polybenzyl copolymer prepared according to the method of U.S. Pat. No. 3,418,259 and comprising units of the formula:

(A)

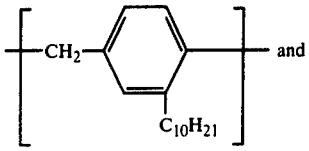

and

-continued (B)

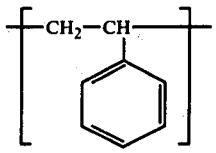

are added with mixing to Desulfurized Arabian Gas Oil (see Table 1 for physical properties) to form Gas Oil Composition A containing 0.06 weight percent of the copolymer. The number average molecular weight of the copolymer is about 21,000 and the weight percent of A units is about 38 with the balance being B units. The pour point of Gas Oil Composition A is measured and found to be substantially less than the pour point of pure Desulfurized Arabian Gas Oil.

EXAMPLE IV

A random-type, oil-soluble copolymer comprising 42 weight percent of units of the formula:

(A)

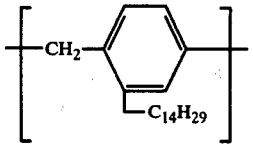

and with the remainder being units of the formula:

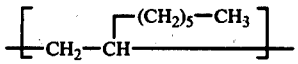

having a number average molecular weight of about 5,600 as determined by vapor pressure osmometry is prepared by the method of U.S. Pat. No. 3,418,259. A quantity of the above-prepared copolymer is added to Nafoora crude (see Table 3 for physical properties) at 160° F. with mixing to form Crude Oil Composition B containing 0.06 weight percent of the described copolymer. The pour point of this composition is measured and is found to be substantially lower than the pour point for Nafoora crude alone.

What is claimed is:

1. A hydrocarbon oil composition comprising a hydrocarbon oil and an effective pour depressant amount of an oil-soluble material selected from the group consisting of:

(A) a polymer comprising recurring units of the formula:

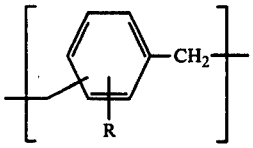

where R is alkyl of from 8 to 26 carbon atoms; and (B) a copolymer comprising in random arrangement about 30 to about 90 weight percent of recurring units of the formula:

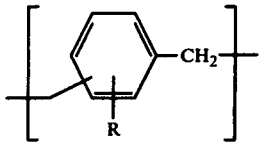

wherein R has the same meaning as previously described and with the remainder being units of the formula:

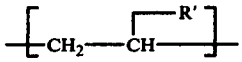

wherein R′ is selected from the group consisting of phenyl and straight chain alkyl of from 4 to about 18 carbon atoms.

2. The hydrocarbon oil composition of Claim 1 wherein the said material is a polymer comprising recurring units of the formula:

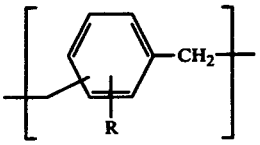

where R is alkyl of from 8 to about 26 carbon atoms.

3. The hydrocarbon oil composition of claim 1 wherein the said material is a copolymer comprising in random arrangement about 30 to about 90 weight percent of units of the formula:

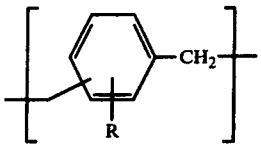

wherein R is alkyl of from 8 to about 26 carbon atoms, and with the remainder being units of the formula:

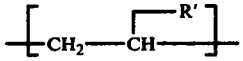

wherein R′ is selected from the group consisting of phenyl and straight chain alkyl of from 4 to about 18 carbon atoms.

4. The hydrocarbon oil composition of claim 3 wherein R′ is phenyl.

5. The hydrocarbon oil composition of claim 3 wherein R′ is straight chain alkyl of from 4 to about 18 carbon atoms.

6. The hydrocarbon oil composition of claim 1 wherein the said composition contains from about 0.01 to about 0.50 weight percent of the oil-soluble material.

7. The hydrocarbon oil composition of claim 1 wherein the said hydrocarbon oil is a middle distillate boiling between 250° and 650° F.

8. The hydrocarbon oil composition of claim 1 wherein the said hydrocarbon oil is a gas oil boiling between 450° and 1050° F.

9. The hydrocarbon oil composition of claim 1 wherein the said hydrocarbon oil is a residual fuel oil.

10. The hydrocarbon oil composition of claim 1 wherein the said hydrocarbon oil is crude oil.

* * * * *